United States Patent [19]

Robinson et al.

[11] 4,228,835

[45] Oct. 21, 1980

[54] BREAKAWAY CAP FOR SOLUTION CONTAINERS

[75] Inventors: Carleton D. Robinson, Des Plaines, Ill.; Jack J. A. Debrauwere, Roosdaal, Belgium

[73] Assignee: Baxter Travenol Laboratories, Inc., Deerfield, Ill.

[21] Appl. No.: 14,443

[22] Filed: Feb. 23, 1979

[51] Int. Cl.[3] ..... B65D 41/32

[52] U.S. Cl. ..... 150/8

[58] Field of Search ..... 150/8; 128/227, 214 D, 128/272, DIG. 24

[56] References Cited

U.S. PATENT DOCUMENTS

| | | | |
|---|---|---|---|
| 3,509,879 | 5/1970 | Bathish | 128/214 D |
| 3,788,374 | 1/1974 | Saijo | 150/8 X |
| 3,927,671 | 12/1975 | Chittenden | 128/227 |

*Primary Examiner*—Donald F. Norton
*Attorney, Agent, or Firm*—Paul C. Flattery

[57] ABSTRACT

A breakaway cap for solution containers having a flexible tube extending from one end of the solution container, and a connector at the distal end of the flexible tube. The breakaway cap includes a ring that is open at one end and adapted for connection to a connector and closed at its opposite end by a handle. Intermediate the open end and the handle is an annularly grooved frangible portion enabling opening of the breakaway cap by bending the handle.

9 Claims, 4 Drawing Figures

BREAKAWAY CAP FOR SOLUTION CONTAINERS

BACKGROUND OF THE INVENTION

This invention relates to equipment used to administer medical solutions and, more particularly, a solution container having a breakaway cap for providing a convenient means to gain access to the contents of the container.

Solution containers are used in many medical procedures. Many containers have flexible tubing extending therefrom for connection to an administration set or medical device such as an artificial kidney. The flexible tubing typically has a connector such as a luer connector at its distal end which is connected to a mating connector on the administration set or medical device.

Generally, the contents of such containers must remain sterile until it is necessary to administer the solution. Some containers have a tear cap connected to the distal end of the flexible tubing extending from the container to maintain sterility. When it is desirable to gain access to the contents of the container, the cap is torn from the tubing or connector.

Tear caps exhibit the disadvantage of requiring excessive force to remove them. Also, they must be grasped in a particular manner to successfully tear the cap. Additionally, if the cap cannot be torn, there is no convenient alternative method of removing them which may result in disposing of the entire solution container.

A proposed solution is to provide a frangible member within the flexible tubing to provide means of gaining access to a solution container as disclosed in co-pending application Ser. No. 818,357, filed July 25, 1977 and assigned to the assignee of this application and now abandoned.

The breakaway port disclosed in U.S. Pat. No. 3,994,412 has a reduced wall section of a width varying from a minimum to a maximum one. Such a breakaway port exhibits the disadvantage of requiring the user to grasp the port in a particular way to efficiently open it. Also, a preweakened portion of this type is relatively difficult to manufacture.

It is, therefore, an object of the present invention to provide a solution container having a breakaway cap which can be conveniently opened and is easier to manufacture than those previously used.

Other objects and advantages of the present invention will become apparent as the description proceeds.

SUMMARY OF THE INVENTION

In accordance with the invention, a solution container having flexible tubing extending therefrom is provided. The flexible tubing has a connector at its distal end for connecting to a connector of an administration set or medical device. This connector may be a luer connector commonly used with medical devices.

The connector attached to the flexible tubing has a breakaway cap which normally closes the connector to fluid flow but which opens the fluid flow path when the cap is broken away. A slide clamp may be provided on the flexible tube to normally block fluid flow but permit fluid flow after the cap is broken.

The breakaway cap includes a ring that is open at one end and closed at its opposite end. The open end has an internal wall surface adjacent thereto that is connected to the external surface of the connector attached to the flexible tubing. The ring has an annularly grooved frangible portion to enable breaking of the ring at the frangible portion. A handle extends from the closed end of the ring to provide a means of grasping the ring and bending it at the frangible portion.

DETAILED DESCRIPTION OF AN ILLUSTRATIVE EMBODIMENT

Figure 1:
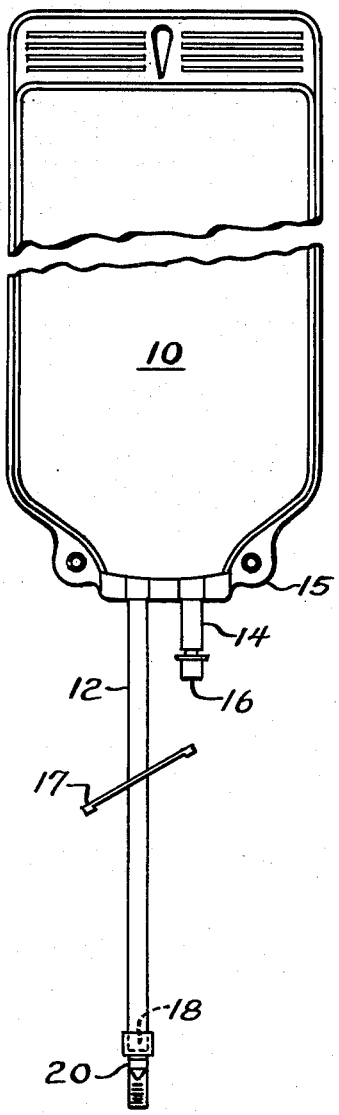
FIG. 1 is a view of a flexible solution container constructed in accordance with the principles of the present invention.

Referring to FIG. 1, a solution container 10 is shown having flexible tubing 12 and an access port 14 extending from one side 15 of the container 10. The access port 14 is capped with an injection site 16 in this embodiment. The solution container 10 is preferably formed of flexible sheet plastic material that is heat sealed at its edges to form a solution bag.

The flexible tubing 12 has a luer connector 18 at its distal end for connection to an administration set or medical device having a mating luer connector.

A conventional slide clamp 17 is provided to prevent fluid flow through the flexible tubing 12 if so desired. The slide clamp 17 may be positioned to prevent fluid flow until the breakaway cap 20 is opened and the luer connection made at which time the slide clamp 17 is moved to allow fluid flow from the solution container 10 thereby preventing spillage of the solution before the connection is made.

The solution container 10 is normally provided with flexible tubing 12, slide clamp 17, luer connector 18 and a breakaway cap 20 (see FIGS. 2–4) which closes the luer connector 18 until the breakaway cap 20 is broken.

Figure 2:
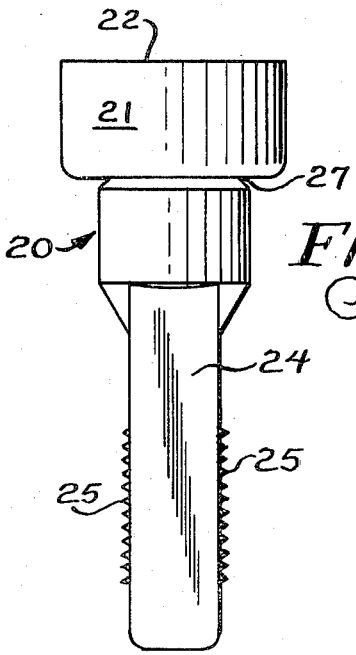
FIG. 2 is an elevational view of a breakaway cap constructed in accordance with the present invention.
Figure 3:
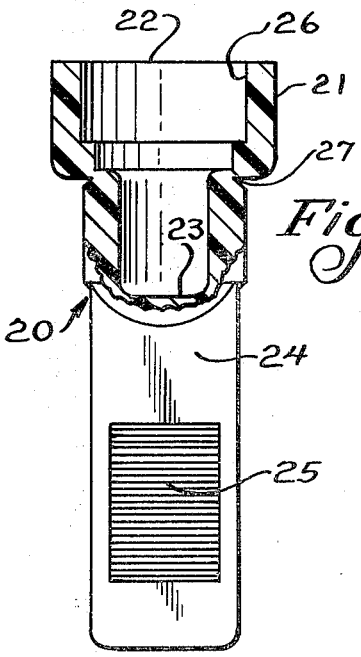
FIG. 3 is a cross-sectional view of the breakaway cap of FIG. 2, fastened to a connector.
Figure 4:
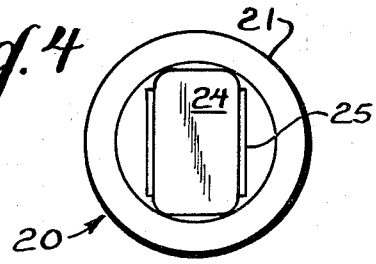
FIG. 4 is a rear elevational view of the breakaway cap of FIG. 2.

Referring now to FIGS. 2–4, it is seen that the breakaway cap 20 comprises a ring 21 having an open end 22 and a closed end 23 with a handle 24 extending rearwardly therefrom. Handle 24 preferably defines serrations 25 on opposite sides thereof, for enabling ease in manually grasping the handle 24.

The internal wall 26 adjacent open end 22 has an internal diameter that is generally equal to the external diameter of the end surface of the luer connector 18. In this manner, surface 26 surrounds and tightly engages a portion of the outside surface of the luer connector 18, with internal surface 26 being solvent-bonded to the luer connector.

It is preferred that the internal diameter of the open end portion 22 of the breakaway cap 20 be slightly greater than the outer diameter of the luer connector 18. This reduces the chance of splitting of the open end portion 22 caused by excessive strain in the internal wall 26 due to shrinking of the breakaway cap 20 after sterilizing the part. For example, using a luer connector 18 having an outer diameter of 6.96 millimeters, it has been found that an open end portion 22 having an internal diameter of 7.07 millimeters adequately compensates for shrinking which may occur after the breakaway cap 20 is sterilized.

An annularly grooved area 27 provides the frangible or breakaway connection between the open end portion 22 of ring 21 and the closed end 23 thereof. Thus when handle 24 is grasped and moved angularly, ring 21 will break at frangible section 27 to remove handle 24 from the luer connector 18, while open end portion 22 of breakaway cap 20 will remain bonded to the luer connector.

It can be seen that breakaway cap 20 acts as a sterility seal on the luer connector 18. When luer connector 18 is to be connected to a mating luer connector, handle 24 is moved angularly to remove it from the ring 21 and, once removed, the luer connectors are coupled together.

It is believed that two variables influence the operability of the present breakaway cap 20. The first is the material out of which the present breakaway cap 20 is molded.

Breaking is believed to require the application of less force than tearing; therefore, a material which will break at annular groove 27 rather than tear is preferred to provide a breakaway cap 20 which is more convenient to use.

Accordingly, it is preferred that the material used to form the breakaway cap 20 comprise a flexible polyvinylchloride having a hardness in the range of 85–100 with 92 being the preferred hardness as measured on the Shore A scale of a durometer. It is to be understood that materials, other than polyvinylcholoride, having physical properties corresponding to those given for polyvinylchloride could also be used in accordance with the present invention.

The second variable is the thickness of the breakaway cap 20 at the annular groove 27. The material at this portion must be thick enough to provide support for the handle 24 to withstand sterilization and to avoid accidental breaking of the cap during shipping and storage but be thin enough to be broken with a minimum amount of force when the breakaway cap 20 is intentionally opened. It is preferred that the thickness of the material at the annular groove 27 be constant to facilitate molding of the breakaway cap 20.

Control of these variables has been found to provide a convenient breakaway cap 20 which may be consistently opened at the appropriate time. For example, using a flexible polyvinylchloride having a hardness of $92 \pm 2$ as measured on the Shore A scale of a durometer, breakaway caps 20 were molded according to the present invention. The thickness of the frangible portion at the annular groove 27 was 0.24 to 0.28 millimeters. Each breakaway cap 20 was solvent bonded to a luer connector 18 connected to flexible tubing 12 extending from the solution container 10. After the container 10 was sterilized, the breakaway cap 20 could be consistently opened by manipulating the handle 24 of the breakaway cap 20 from a vertical position to a horizontal position. No more than two such manipulations were required to open any breakaway cap 20.

Although an illustrative embodiment of the invention has been shown and described, it is to understood that modifications and substitutions may be made by those skilled in the art without departing from the novel spirit and scope of the present invention as defined by the appended claims.

We claim:

1. In a container of the type having a flexible tube extending therefrom and having a first connector at the distal end of the flexible tube for connecting to a second connector, the improvement comprising: a breakaway cap connected to said first connector which normally closes the first connector to fluid flow but which opens the fluid flow path when the cap is broken away, said breakaway cap having a frangible annular section of reduced thickness, and handle means extending longitudinally outwardly from said breakaway cap and first connector along the axis of said breakaway cap, said breakaway cap comprising a molded member made of a flexible plastic similar in physical properties to polyvinyl chloride and having a hardness of essentially 85 to 100 on the Shore A Durometer scale.

2. The container in claim 1, wherein said container comprises a flexible plastic bag.

3. The container of claim 1, wherein said breakaway cap comprises a ring that is open at one end and closed at its opposite end, with the open end having an internal wall surface adjacent thereto that is connected to the external surface of said first connector, said ring defining said frangible annular section of reduced thickness enabling breakage of said ring at said frangible section.

4. The container in claim 3 wherein said annularly grooved, frangible portion has a thickness of 0.24 to 0.28 millimeters.

5. A breakaway cap for providing an openable end seal, said breakaway cap defining a frangible annular section of reduced wall thickness to permit breaking away of an end of the breakaway cap, said breakaway cap carrying handle means projecting longitudinally outwardly from said end along the longitudinal axis of said breakaway cap, said breakaway cap being made of a flexible plastic similar in physical properties to polyvinyl chloride and having a hardness of essentially 85 to 100 on the Shore A Durometer scale.

6. The breakaway cap of claim 5 which is attached to a first connector, carried at the end of a flexible tube extending from a container.

7. The breakaway cap of claim 5 which is made of polyvinyl chloride.

8. The breakaway cap of claim 7 which has a hardness of essentially 90 to 100 on the Shore A Durometer scale.

9. The breakaway cap of claim 5 in which said frangible annular section of reduced thickness has a thickness of 0.24 to 0.28 mm.

* * * * *